US009322271B2

(12) United States Patent
Yamada

(10) Patent No.: US 9,322,271 B2
(45) Date of Patent: Apr. 26, 2016

(54) CRYOGENIC REFRIGERATOR

(71) Applicant: SUMITOMO HEAVY INDUSTRIES, LTD., Tokyo (JP)

(72) Inventor: Koji Yamada, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 572 days.

(21) Appl. No.: 13/755,260

(22) Filed: Jan. 31, 2013

(65) Prior Publication Data

US 2013/0220111 A1 Aug. 29, 2013

(30) Foreign Application Priority Data

Feb. 24, 2012 (JP) ..... 2012-039244

(51) Int. Cl.
*F25B 9/14* (2006.01)
*F01B 19/02* (2006.01)

(52) U.S. Cl.
CPC .. *F01B 19/02* (2013.01); *F25B 9/14* (2013.01)

(58) Field of Classification Search
CPC ..... F01B 19/02; F25B 9/14
USPC ..... 92/85 R, 85 A; 62/6; 60/520
See application file for complete search history.

(56) References Cited

U.S. PATENT DOCUMENTS 4,074,530 A * 2/1978 Polster ..... 60/518
4,180,984 A * 1/1980 Chellis ..... F25B 9/14 60/522
4,333,755 A * 6/1982 Sarcia ..... 62/6
4,346,768 A * 8/1982 Ross ..... 173/118
4,514,987 A * 5/1985 Pundak et al. ..... 62/6
4,619,112 A * 10/1986 Colgate ..... 62/6
4,642,995 A * 2/1987 Bachler et al. ..... 62/6
4,822,390 A * 4/1989 Kazumoto et al. ..... 62/6
4,922,722 A * 5/1990 Kazumoto et al. ..... 62/6
5,090,206 A * 2/1992 Strasser ..... 62/6
5,103,647 A * 4/1992 Ackermann ..... 62/6
5,361,588 A * 11/1994 Asami ..... F25B 9/14 60/520
5,483,802 A * 1/1996 Kawajiri et al. ..... 62/6
5,596,875 A * 1/1997 Berry et al. ..... 62/6
5,846,059 A * 12/1998 Mizuno et al. ..... 417/273

FOREIGN PATENT DOCUMENTS

| | | |
|---|---|---|
| JP | 01-139958 | 6/1989 |
| JP | H01-147264 | 6/1989 |
| JP | H02-183768 | 7/1990 |
| JP | H05-312426 | 11/1993 |
| JP | 06-058641 | 3/1994 |
| JP | H06-300378 | 10/1994 |
| JP | 07-019639 | 1/1995 |
| JP | 2001-164993 | 6/2001 |
| JP | 2005-037118 | 2/2005 |
| JP | 2011-017457 | 1/2011 |

* cited by examiner

*Primary Examiner* — Thomas E Lazo
(74) *Attorney, Agent, or Firm* — Ipusa, PLLC

(57) ABSTRACT

A disclosed cryogenic refrigerator includes a cylinder, a displacer reciprocally moving inside the cylinder, and an elastic unit which is provided in at least one of a pair of end regions respectively including a pair of end portions within a range of a reciprocal motion of the displacer, accumulates an elastic force when the displacer approaches the end portion, and releases the elastic force when the displacer departs from the end portion.

9 Claims, 5 Drawing Sheets

CRYOGENIC REFRIGERATOR

CROSS-REFERENCE TO RELATED APPLICATIONS

This patent application is based upon and claims the benefit of priority of Japanese Patent Application No. 2012-039244 filed on Feb. 24, 2012 the entire contents of which are incorporated herein by reference.

BACKGROUND OF THE INVENTION

1. Field of the Invention

The present invention generally relates to a cryogenic refrigerator which generates cold (a cold thermal energy causing an ultracold temperature) by generating Simon expansion using a high-pressure refrigerant gas supplied from a compression device.

2. Description of the Related Art

An example cryogenic refrigerator is disclosed in Patent Document 1. In this technique, a rotary motion of a motor is converted to a reciprocal motion by a scotch yoke mechanism to move a displacer.

In this cryogenic refrigerator, while reciprocating the displacer inside the cylinder and opening or closing a valve, a refrigerant gas inside an expansion space formed by the cylinder and the displacer is expanded to thereby generate cold. By transferring cold to a cooling stage positioned on a side of an outer periphery side on the expansion space, an object to be cooled can be frozen.

In the cryogenic refrigerator, provided that a position of the displacer in which an expansion space on a low temperature side is the minimum is called an "upper dead end" and a position of the displacer in which an expansion space on a low temperature side is the maximum is called an "lower dead end", the refrigerant gas is taken in or supplied to by the valve before the displacer reaches the upper dead end. The upper dead end and the lower dead end can be in a manner opposite to the above.

[Patent Document 1] Japanese Laid-open Patent Publication No. 2011-17457

SUMMARY OF THE INVENTION

According to an aspect of the present invention, there is provided a cryogenic refrigerator including a cylinder, a displacer reciprocally moving inside the cylinder, and an elastic unit which is provided in at least one of a pair of end regions respectively including a pair of end portions within a range of a reciprocal motion of the displacer, accumulates an elastic force when the displacer approaches the end portion, and releases the elastic force when the displacer departs from the end portion.

DETAILED DESCRIPTION OF THE PREFERRED EMBODIMENTS

Immediately before an upper dead end of a displacer, the direction of the force of pressure loss of a refrigerant gas acting on the displacer becomes the same as the flowing direction of the refrigerant gas because the movement direction of the refrigerant gas is the same as the movement direction of the displacer. The force of pressure loss functions as a biasing force in the movement direction of the displacer to thereby positively assist a rotational force of a motor.

Immediately after the upper dead end of a displacer, the direction of the force of pressure loss of the refrigerant gas acting on the displacer is adverse to the flowing direction of the refrigerant gas because the movement direction of the refrigerant gas is adverse to the movement direction of the displacer. The force of pressure loss functions as a force of preventing the displacer from moving in the movement direction of the displacer to thereby negatively assist the rotational force of the motor. This positive force and the negative force are generated around a lower dead center because the refrigerant gas is ejected before reaching the lower dead end.

In the above described related art, immediately after the displacer reaches the lower dead end or the upper dead end, the negative force caused by the pressure loss becomes a load (a drag) for the motor. Thus, there may occur an inconvenience such as a slip in the motor.

It is an object of the embodiment of the present invention, regardless of the pressure loss generated by the refrigerant gas, to provide a cryogenic refrigerator in which inconvenience such as the slip in the motor is effectively avoided by preventing the negative force from acting on the motor.

A description is given below, with reference to the FIG. 1 through FIG. 6 of embodiments of the present invention.

Where the same reference symbols are attached to the same parts, repeated description of the parts is omitted.

(Embodiment)

Figure 1:
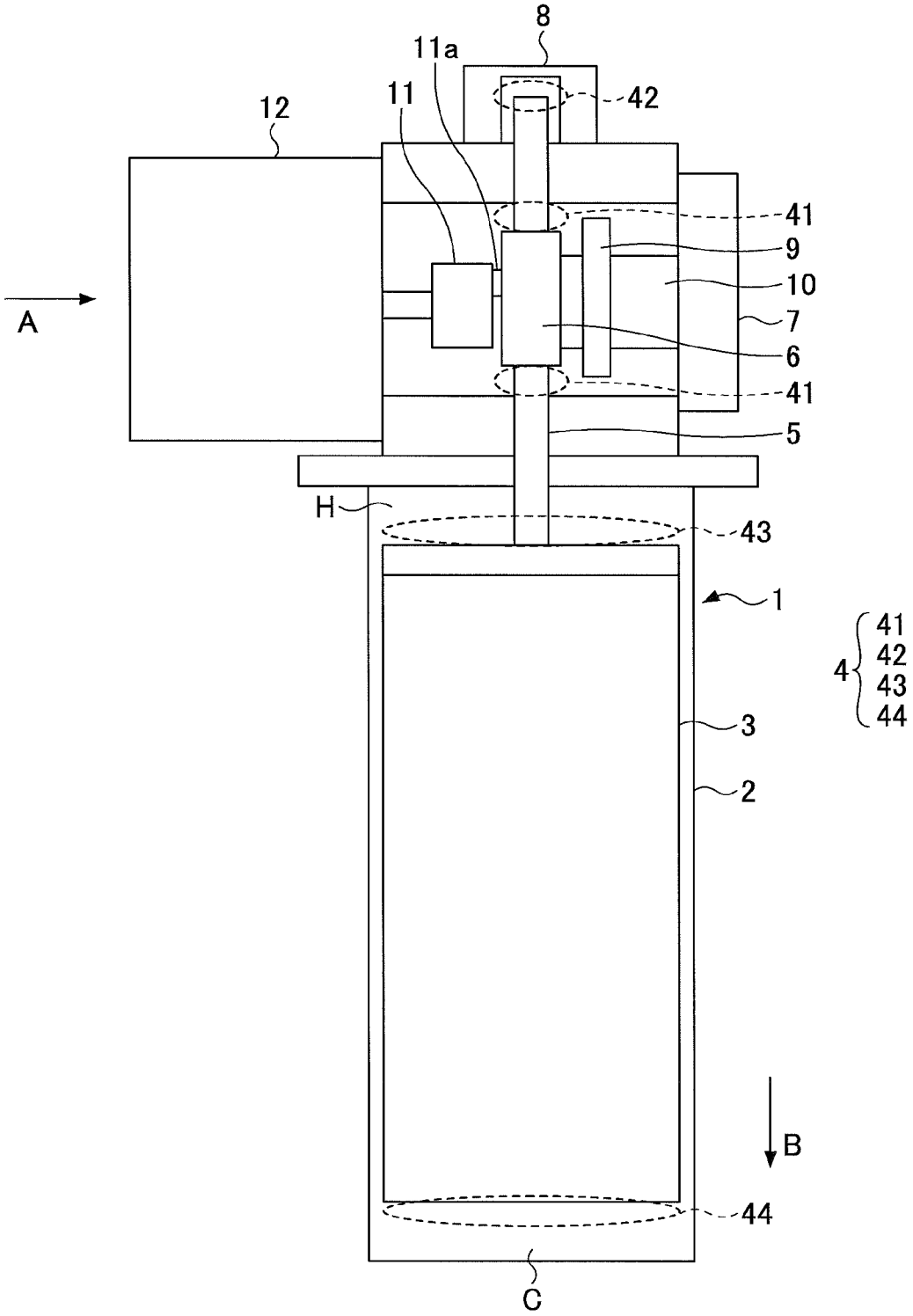
FIG. 1 schematically illustrates an exemplary cryogenic refrigerator of an embodiment.

Referring to FIG. 1, a cryogenic refrigerator 1 of the embodiment is a Gifford-McMahon (GM) type refrigerator using, for example, a helium gas as a refrigerant gas. The cryogenic refrigerator 1 includes a cylinder 2, a displacer 3, an elastic unit 4, a rod 5, a window 6, a housing 7, an upper cover 8, a valve plate 9, a valve 10, a scotch yoke mechanism 11, and a motor 12.

A clearance is formed between the cylinder 2 and the displacer 3. The displacer 3 is movable inside the cylinder 2. Referring to FIG. 1, on the side B of the displacer 3, an expansion space C is formed. On the side opposite to the side B of the displacer 3, a room temperature chamber H is formed. Although it is not illustrated in FIG. 1, a cooling stage is adjacent to the expansion space C so as to enclose the expansion space C. The cooling stage is made of a material having a high thermal conductivity such as copper, aluminum, stainless or the like.

The cylinder 2 accommodates the displacer 3 so that he displacer 3 is reciprocally movable in the longitudinal directions of the cylinder 2. The cylinder 2 is made of, for example, a stainless steel in view of its strength, thermal conductivity, and helium shielding capability. On a high temperature end opposite to the side B of the cylinder 2 in FIG. 1, the scotch yoke mechanism 11 causes the displacer to reciprocate based on rotation of the motor 12. A crank shaft 11*a* is inserted to the window 6 formed in a middle of the rod 5, to which the displacer 3 is connected, so that the crank shaft 11*a* is movable in a direction perpendicular to the axial direction of the rod 5.

The scotch yoke mechanism 11, the window 6, the valve plate 9, and the valve 10 are arranged in the right and left directions in FIG. 1. The housing 7 is provided to cover these components. The rod end of the rod 5 protrudes on the side opposite to the side B and penetrates the housing 7. The rod end of the rod 5 is covered by the upper cover 8.

The displacer 3 reciprocates in the axial direction of the cylinder 1 by the scotch yoke mechanism 11. Further, the tip of the crank shaft 11*a* is connected to a pin hole (not illustrated) of the valve plate 9. The valve plate 9 is rotated by the scotch yoke mechanism 11 to open and close the valve 10 of a rotary type in an appropriate timing.

The displacer 3 has a cylindrical outer peripheral surface. A regenerative material (not illustrated) fills the inside of the displacer 3. The inner capacity of the displacer 3 forms a regenerator (not illustrated). A flow controller (not illustrated) is provided on the upper end side, namely the side of the high temperature end, of the regenerator to control a flow of the helium. Another flow controller (not illustrated) is provided on the lower end side of the regenerator to control a flow of the helium.

On the high temperature end of the displacer 3, an opening (not illustrated) for causing the refrigerant gas to pass through from the room temperature chamber H to the displacer 3 is formed. The room temperature chamber H is a space formed by the cylinder 2 and the displacer 3 on the high temperature ends. The capacity of the room temperature chamber H changes along with the reciprocation of the displacer 3.

The room temperature chamber H is connected to a supply and discharge pipe among pipes connecting a supply and discharge system including a compressor, a valve plate 9, and the supply valve 10. A seal (not illustrated) is provided between a portion near the high pressure end of the displacer 3 and the cylinder 2.

On the low temperature end of the displacer 3, an opening (not illustrated) for introducing the refrigerant gas via the clearance to the expansion space C is formed. The expansion space C is a space formed by the cylinder 2 and the displacer 3 on the side of B in FIG. 1. The capacity of the expansion space C changes the reciprocation of the displacer 3. At the positions corresponding to the outer periphery and the bottom portion of the cylinder 2, the cooling stage thermally connected to the object to be cooled is provided. The cooling stage is cooled by the refrigerant gas passing through the clearance.

The displacer 3 is made of a resin such as Bakelite (phenol resin including fabric) in view of the specific gravity, the abrasion resistance, the strength, and the thermal conductivity. For example, a metallic screen or the like is used for the first regenerative material.

Within the embodiment, the elastic unit 4 includes a first elastic body 41, a second elastic body 42, a third elastic body 43, and a fourth elastic body 44. Referring to FIG. 1, the first elastic body 41 is positioned in a pair of gaps between the window 6 and the housing 7 in the axial direction. Referring to FIG. 1, the second elastic body 42 is positioned in a gap between the rod end and the upper cover 8 in the axial direction. The third elastic body 43 is positioned on the side of the room temperature chamber H, namely the side of the high temperature end. The fourth elastic body 44 is positioned on the side of the expansion space C, namely the side of the low temperature end.

Figure 2:
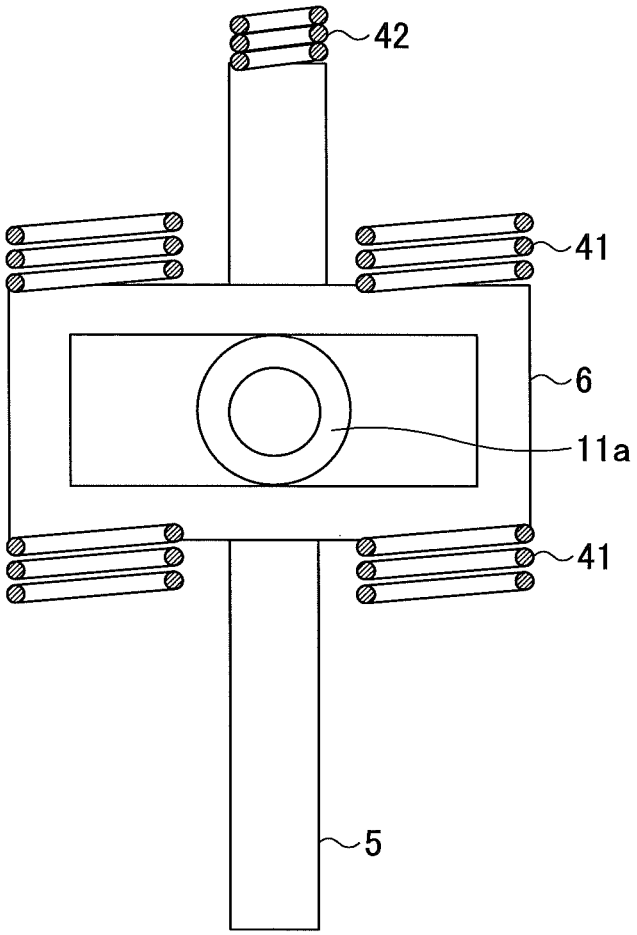
FIG. 2 schematically illustrates an embodiment of a first elastic body at a window which is connected to the displacer 3 of the cryogenic refrigerator 1 and a second elastic body 42 at an end of a rod.

The first elastic body 41 and the second elastic body 42 are formed by coil springs as illustrated in FIG. 2. FIG. 2 is a view taken along an arrow A in FIG. 1. One ends of each of four pieces of the first elastic body 41 is joined and fixed to the side of the window 6 by an appropriate joining means such as a bond. One end of the second elastic body 42 is joined to the rod end of the rod 5. The other end is also a free end.

Figure 3:
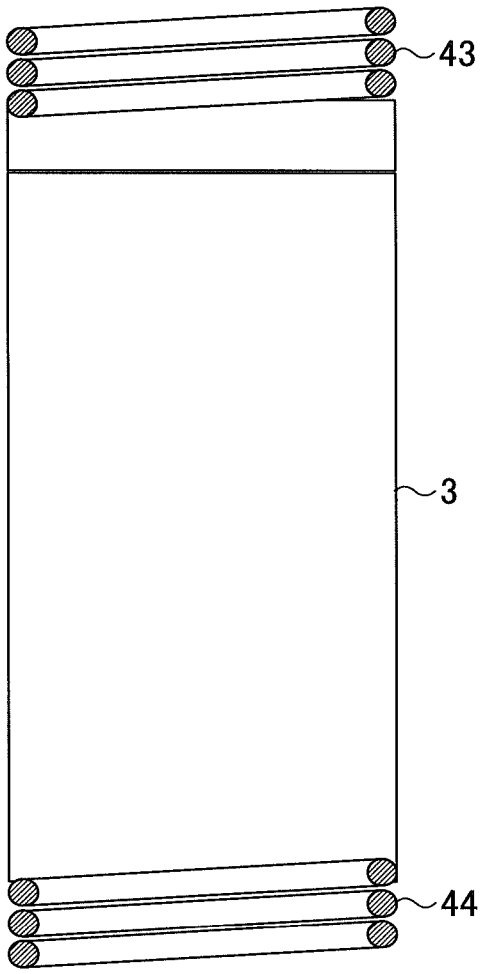
FIG. 3 schematically illustrates an embodiment of a third elastic body 43 connected to a high temperature end of the displacer 3 of the cryogenic refrigerator 1 and a fourth elastic body 44 connected to a low temperature end of the displacer 3 of the cryogenic refrigerator 1.

Referring to FIG. 3, the third elastic body 43 and the fourth elastic body 44 are formed by coil springs. The one end of the third elastic body 43 is joined to the side of the high temperature end of the displacer 3, and the other end of the third elastic body 43 is a free end. The one end of the fourth elastic body 44 is joined to the side of the low temperature end of the displacer 3, and the other end of the fourth elastic body 43 is a free end.

The free lengths of the second elastic body 42, the first elastic body 41, and the third elastic body 43, while the biasing forces of the second elastic body 42, the first elastic body 41, and the third elastic body 43 do not act on the side of the high temperature end, are determined so that the other ends of the second elastic body 42, the first elastic body 41, and the third elastic body 43 contact an upper bottom surface of the upper cover 8, an upper bottom surface of the housing 7, and an upper bottom surface of the cylinder 2, respectively, only when the displacer 3 is positioned on a region of the end portion within a predetermined length including the lower dead end on the side of the high temperature end.

The free lengths of the first elastic body 41 and the fourth elastic body 44, while the biasing forces of the first elastic body 41 and the fourth elastic body 44 do not act on the side of the low temperature end, are determined so that the other ends of the first elastic body 41 and the fourth elastic body 44 contact a lower bottom surface of the housing 7 and a lower bottom surface of the cylinder 2, respectively, only when the displacer 3 is positioned on a region of the end portion within a predetermined length including the upper dead end on the side of the low temperature end.

Next, the operation of the refrigerator is described. At a timing in a process of supplying the refrigerant gas, the displacer 3 is positioned at the upper dead end of the cylinder 2 on the side of B. If the valve 10 is opened before the displacer 3 reaches the upper dead end along with the rotation of the valve plate 9, a high pressure helium gas is supplied from the supply and discharge pipe into the cylinder 2 and flown unto a regenerator inside the displacer 3 from an opening positioned upper the displacer 3. The high pressure helium gas flown into the regenerator is supplied into the expansion space C via an opening into a clearance which is positioned lower than the displacer 3 while being cooled by the regenerative material.

As described, the expansion space C is filled with the high pressure helium gas and the valve 10 is closed. At this time the displacer 3 is positioned at the lower dead end on the side opposite to the side B in FIG. 1 inside the cylinder 2. If the valve 10 is opened before the displacer 3 reaches the lower dead end, the refrigerant gas in the expansion space C is depressurized to expand. The helium gas in the expansion space C which has become low absorbs heat of the cooling stage via the clearance.

The displacer 3 moves toward the upper dead end to thereby reduce the capacity of the expansion space C. The helium gas inside the expansion space C is returned to the supply side of the compressor via the clearance C, the opening, the regenerator, and the opening. At this time, the regenerative material is cooled by the refrigerant gas. These processes form one cycle. The refrigerator cools the cooling stage by repeating the cycle.

Figure 4:
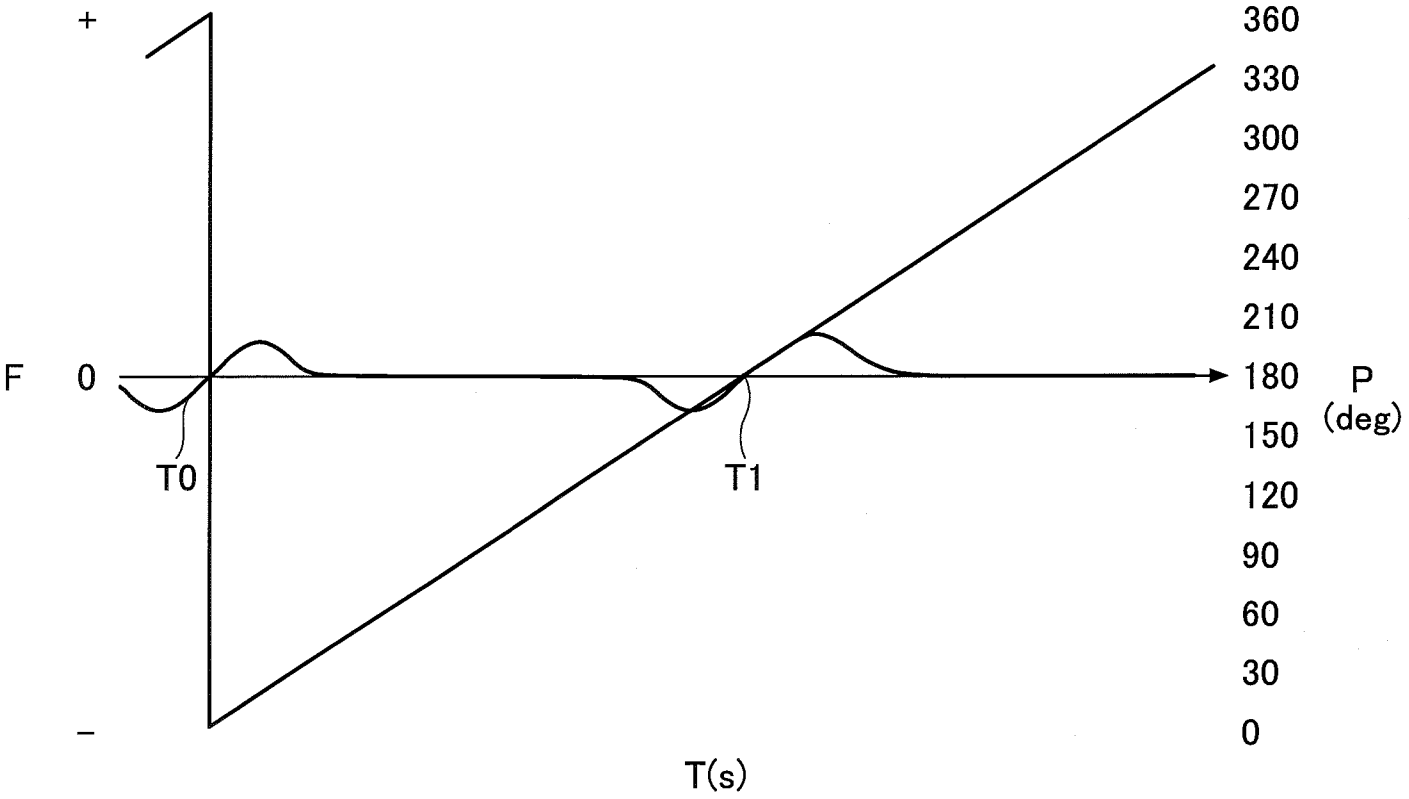
FIG. 4 is an exemplary graph illustrating a force of a pressure loss in a refrigerant gas caused by a reciprocal motion of a displacer of the embodiment.

FIG. 4 schematically illustrates an exemplary relationship between the motion of the displacer 3 and the pressure loss F. Referring to FIG. 4, the abscissa represents a time T(s), and the ordinate represents an angle of the crank shaft 11*a* of the scotch yoke mechanism 11 corresponding to the position P of the displacer 3 inside the cylinder 2. Referring to FIG. 4, 0 degree (360 degrees) corresponds to the upper dead end, and 180 degree corresponds to the lower dead end. Along the ordinate, the force of pressure loss F increases in the direction (−) of assisting the motor 12 as the indicator of the ordinate becomes higher. The force of pressure loss F decreases in the adverse direction (+) as the indicator of the ordinate becomes lower.

At the time T0, the displacer 3 is positioned at the upper dead center. Because the supply of the helium gas starts before the upper dead end, the force of the pressure loss F acts in the direction of assisting the motor 12 from before the upper dead end to the upper dead end and acts in the adverse direction from the upper dead end. At the time T1, the displacer 3 is positioned at the lower dead end. Because the discharge of the helium gas starts before the lower dead end, the force of the pressure loss F acts in the direction of assisting the motor 12 from before the lower dead end to the upper dead end and acts in the adverse direction from the upper dead end.

At this time, because the cryogenic refrigerator 1 of the embodiment includes the first elastic body 41 and the fourth elastic body 44, when the valve 10 is opened to start the supply before the upper dead end, the force of the pressure loss acting to assist the motor 12 is accumulated in the first elastic body 41 and the fourth elastic body 44 as an elastic force. The elastic force is released immediately after the upper dead end. Therefore, the force F of the pressure loss in the adverse direction can be canceled by the elastic force thereby preventing the load (the drag) from acting on the motor 12.

Because the cryogenic refrigerator 1 of the embodiment includes the second elastic body 42, the first elastic body 41 and the third elastic body 43, when the valve 10 is opened to start the discharge before the lower dead end, the force of pressure loss of the refrigerant gas, which acts on the direction of assisting the motor immediately before the lower dead end, is accumulated in the first elastic body 41 and the fourth elastic body 44. Therefore, the force F of the pressure loss in the adverse direction immediately after the lower dead end can be canceled by the elastic force thereby preventing the load (the drag) from acting on the motor 12.

Figure 5:
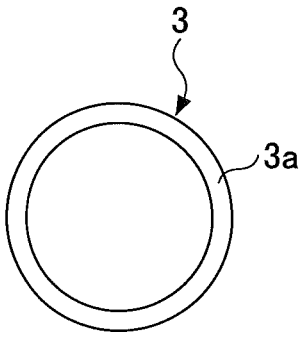
FIG. 5 is an exemplary plan view of a recess corresponding to a third elastic body of the displacer of the cryogenic refrigerator of the embodiment.

The sizes of the elastic body of the embodiment illustrated in FIGS. 2 and 3 are only examples. Especially, the relative sizes of the third and fourth elastic bodies installed in the displacer 3 of the embodiment illustrated in FIGS. 2 and 3 are appropriately set to be sizes without affecting the supply and the discharge. In conformity with the installation of the third elastic body 43, an annular recess 3*a* for accommodating the third elastic body 43 may be provided on the upper bottom surface of the displacer 3 on the high temperature side of the displacer 3 as illustrated in FIG. 5 viewed along the axial direction of the displacer 3. When the displacer 3 is positioned at the lower dead end, the compressed third elastic body 43 is accommodated in the recess 3*a* to prevent the dead volume from being formed by the third elastic body 43.

Figure 6:
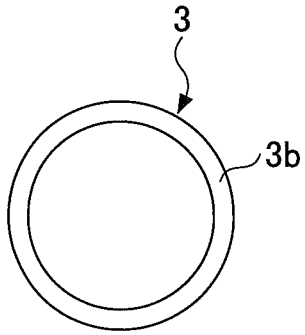
FIG. 6 is an exemplary plan view of a recess corresponding to a third elastic body of the displacer of the cryogenic refrigerator of the embodiment.

In conformity with the installation of the fourth elastic body 44, an annular recess 3*b* for accommodating the fourth elastic body 44 may be provided on the upper bottom surface of the displacer 3 on the low temperature side of the displacer 3 as illustrated in FIG. 6 viewed along the axial direction of the displacer 3. When the displacer 3 is positioned at the upper dead end, the compressed fourth elastic body 44 is accommodated in the recess 3*b* to prevent the dead volume from being formed by the fourth elastic body 44.

Although the cryogenic refrigerator described above has the one stage of the displacer, the number of the stages may be appropriately changed to two, three, or the like. With the above embodiments, the example that the cryogenic refrigerator is the GM refrigerator is described. However, the embodiments are not limited thereto. For example, the embodiments are applicable to any refrigerator having the displacer such as a Stirling type refrigerator or a Solvay type refrigerator.

To solve the above problems, the cryogenic refrigerator of the embodiment includes a cylinder, a displacer reciprocally moving inside the cylinder, and an elastic unit which is provided in at least one of a pair of end regions respectively including a pair of end portions within a range of a reciprocal motion of the displacer, accumulates an elastic force when the displacer approaches the end portion, and release the elastic force when the displacer departs from the end portion.

The end portion described above is the upper dead end or the lower dead end. An end region may include the upper dead end and the other one including the lower dead end. In the embodiment, the elastic unit functions as described above in at least the one or the other. The range of the reciprocal motion includes an intermediate point of the reciprocal motion other than the end portions. The length of the end region is shorter than the distance between the end portion and the intermediate point and is determined by characteristics of the force of the pressure loss of the refrigerant gas acting on the displacer.

The elastic unit may include the first elastic body provided in the window as the part of the scotch yoke mechanism and the second elastic body provided in the rod end of the rod connected to the displacer. Further, the elastic unit may include the third elastic body provided in the high temperature end of the displacer. Further, the elastic unit may include the fourth elastic body provided in the low temperature end of the displacer. In addition, the elastic unit is, for example, a coil spring. The coil spring may be joined to the side of the displacer or the side of the cylinder. The end of the coil spring which is not joined is a free end. The free end contacts the other side of the displacer or the cylinder only in the end region.

The recess accommodating the third elastic body or the fourth elastic body may be included in the displacer or the cylinder. The recess is sufficient to have the depth of preventing the dead volume from being formed by the third elastic body or the fourth elastic body by accommodating the compressed third elastic body and the compressed fourth elastic body in a space between the displacer and the cylinder in the axial direction.

The embodiment uses the force of the pressure loss generated along with the supply and discharge of the refrigerant gas which functions in the direction of assisting the movement of the displacer and in the direction of avoiding after passing the end portion. Based on the installation of the elastic unit, the force of the pressure loss in the direction of assisting the motor is accumulated as the elastic force. The elastic force is released after the displacer passes the end portion to thereby cancel the force of avoiding the movement of the displacer by the released elastic force. With this, it is possible to prevent inconvenience such as a slip caused by excessive torque of the motor driving the scotch yoke mechanism. The embodiment of the present invention is preferable applicable to various cryogenic refrigerators.

With the cryogenic refrigerator of the embodiment, the positive force generated in a case where the supply to the expansion space is started immediately before the upper dead end and in a case where the discharge is started immediately before the lower dead end is used and accumulated in the elastic unit as the elastic force immediately before the displacer reaches the end portion.

With this, immediately after the displacer reaches the end portion, the elastic force is released to cancel the negative force caused by the pressure loss. Thus, it is possible to prevent the negative force from being transmitted to the motor moving the motor via the scotch yoke mechanism. Said differently, it is possible to effectively prevent inconvenience such as the slip in the motor caused by the load (the drag).

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the cryogenic refrigerator has been described in detail, it should be understood that the various changes, substitutions, and alterations could be made hereto without departing from the spirit and scope of the invention.

What is claimed is:

1. A cryogenic refrigerator comprising:

a compressor compressing a refrigerant gas;

a displacer reciprocally moving between an upper dead end and a lower dead end, and containing a regenerative material;

a cylinder containing the reciprocally moving displacer;

a scotch yoke mechanism causing the displacer to reciprocate based on rotation of a motor:

a rotary valve selectively connecting the cylinder to a supply side or a discharge side of the compressor; and an elastic unit which accumulates a force by the refrigerant gas acting on the displacer as an elastic force when the displacer approaches the upper dead end or the lower dead end, and which releases the accumulated elastic force as a force which cancels a force by the refrigerant gas acting on the displacer when the displacer departs from the upper dead end or the lower dead end.

2. The cryogenic refrigerator according to claim 1, wherein the elastic unit includes a first elastic body positioned between the scotch yoke mechanism and a housing in a movement direction of the displacer.

3. The cryogenic refrigerator according to claim 1, further comprising a rod having one end connected to the displacer, wherein the elastic unit includes a second elastic body positioned between the other end of the rod and a cover fixed to a housing.

4. The cryogenic refrigerator according to claim 1, wherein the elastic unit includes a third elastic body positioned between a high temperature end of the cylinder and a high temperature end of the displacer.

5. The cryogenic refrigerator according to claim 1, wherein the elastic unit includes a fourth elastic body positioned between a low temperature end of the cylinder and a low temperature end of the displacer.

6. The cryogenic refrigerator according to claim 4, wherein the displacer or the cylinder includes a recess for accommodating the third elastic body.

7. The cryogenic refrigerator according to claim 5, wherein the displacer or the cylinder includes a recess for accommodating the fourth elastic body.

8. The cryogenic refrigerator according to claim 1, wherein the rotary valve opens a pipe connecting between the cylinder and the discharge side of the compressor before the displacer reaches the upper dead end.

9. The cryogenic refrigerator according to claim 1, wherein the rotary valve opens a pipe connecting between the cylinder and the supply side of the compressor before the displacer reaches the lower dead end.

* * * * *